United States Patent [19]

Eastman, II et al.

[11] Patent Number: 4,797,796

[45] Date of Patent: Jan. 10, 1989

[54] ELECTRIC LANTERN WITH OSCILLATING FEATURE

[75] Inventors: Lewis K. Eastman, II, Parker; Robert L. Bromley, Boulder, both of Colo.

[73] Assignee: L. Kent Eastman Co., Inc., Parker, Colo.

[21] Appl. No.: 118,607

[22] Filed: Nov. 9, 1987

[51] Int. Cl.[4] ..... F21L 7/00

[52] U.S. Cl. ..... 362/199; 362/286; 362/428

[58] Field of Search ..... 362/199, 269, 271, 272, 362/286, 287, 386, 427, 428

[56] References Cited

U.S. PATENT DOCUMENTS

| | | | |
|---|---|---|---|
| 762,215 | 6/1904 | Webber . | |
| 1,991,753 | 2/1935 | Kurlander | 362/109 |
| 2,574,621 | 11/1951 | Chun | 362/272 X |
| 2,954,771 | 10/1960 | Boyan | 362/272 X |
| 3,603,783 | 9/1971 | Schwartz | 240/10.69 |
| 3,865,790 | 2/1975 | DuShane | 362/272 |
| 4,129,899 | 12/1978 | Dunbar | 362/109 |
| 4,447,863 | 5/1984 | Fenne | 362/199 |

*Primary Examiner*—Stephen F. Husar

*Attorney, Agent, or Firm*—Gregory U. O'Connor; Edna M. O'Connor

[57] ABSTRACT

The present invention concerns an electric lantern preferably of the flashlight type. The lantern uses batteries for a power source, and a switch for selectively activating the lantern. The lantern also has an optical system which includes a bulb and reflector for directing the light in a relatively narrow beam of light. A motor contained in the lantern is used to bring about oscillating movement of the bulb and reflector. This oscillating movement is activated by the switch which can be selectively operated to cause the beam of light to scan a wide, horizontal area. Alternatively, the switch can be activated to power the lamp bulb only-as in a conventional flashlight.

21 Claims, 1 Drawing Sheet

FIG. 5

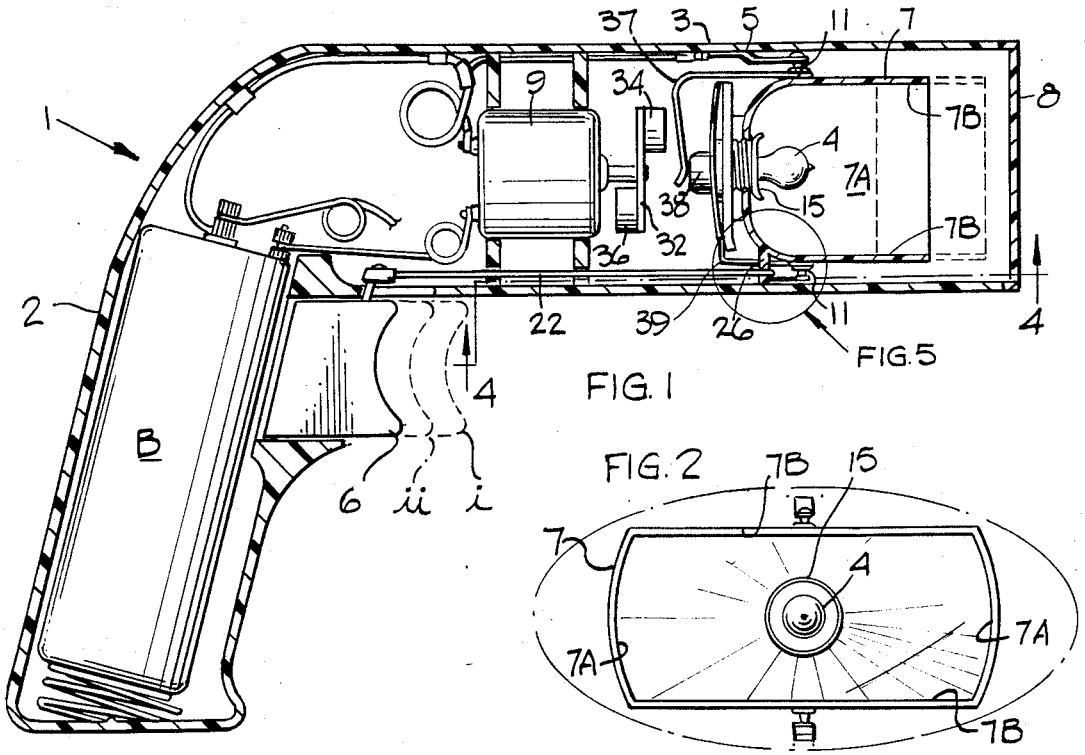
FIG. 1
FIG. 2
FIG. 5.
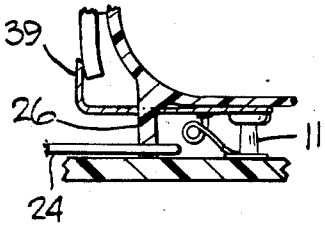
FIG. 4.
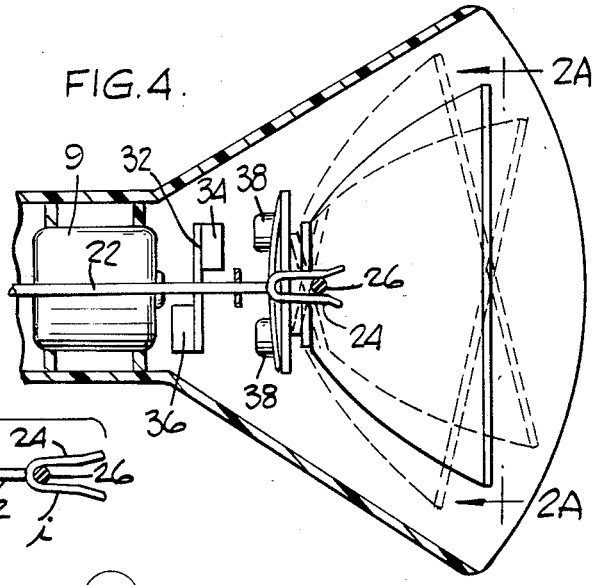
FIG. 6
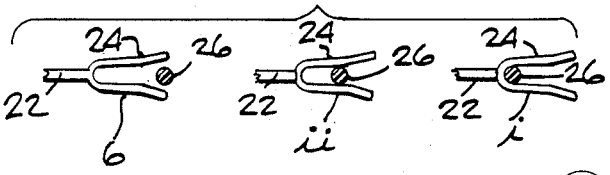
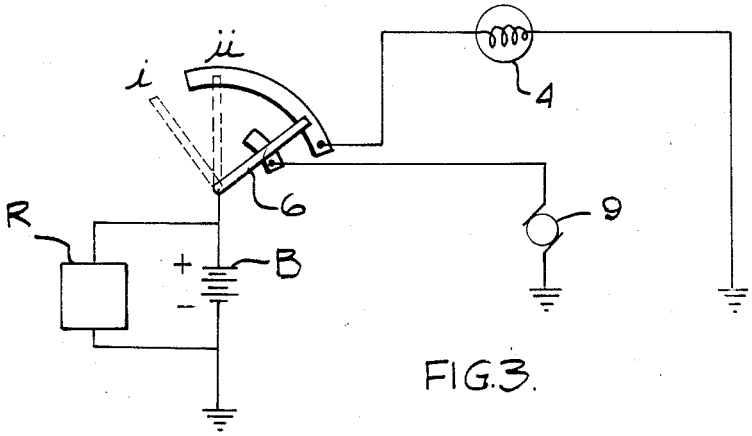
FIG. 3.

ELECTRIC LANTERN WITH OSCILLATING FEATURE

TECHNICAL FIELD

The present invention relates to the area of electric lanterns including flashlights. More particularly the invention is concerned with directing a relatively narrow beam of light from an electric lantern so that a broader viewing area may be achieved. Specifically, this is accomplished by selectively oscillating the bulb and reflector of the lantern. A motor and magnetic drive contained in the electric lantern is used to achieve such oscillation.

BACKGROUND OF THE PRIOR ART

Electric lanterns have been proposed with selectively directional bulb and reflector combinations. Such a lantern is shown in U.S. Pat. No. 4,447,863 to Fenne. In this patent, however, the rotation of the bulb and reflector is accomplished manually. Fenne does not provide for oscillation of the bulb/reflector combination by selectively activated means within the lantern. Similarly, the patent of Dunbar (U.S. Pat. No. 4,129,899) provides a flashlight with a rotatable lamp holder. Again the lamp holder, reflector and bulb combination are articulated manually. Dunbar does not provide means for selectively oscillating the reflector/bulb combination. U.S. Pat. No. 1,991,753 to Kurlander shows an adjustable light diffuser in a electric lantern. The light diffuser is manually adjustable and moves along the axis of the lamp/reflector combination to adjust the beam of light from a tight beam to a broad flood. Oscillating movement is not disclosed. The patent to Schwartz (U.S. Pat. No. 3,603,783) shows magnetic lamp focussing and switching. A motor drive is not provided, nor is there oscillating movement of the bulb and reflector. The movement of the switch of Schwartz indicates the direction of movement of the bulb. Oscillation is not provided for as the bulb moves only in a single direction when the switch is activated. The patent to Webber (U.S. Pat. No. 762,215) is directed to the field of searchlights, not hand held lanterns or flashlights.

BRIEF DESCRIPTION OF THE INVENTION

Accordingly, applicants have provided a hand held lantern or flashlight with means for oscillating the bulb and reflector to provide a greater range of light without the expected loss of light intensity characteristic of prior art lanterns which vary the spread of the beam from a focussed to a relatively diffused flood. Applicant's lantern utilizes a motor and magnetic drive means for providing movement to the bulb and reflector. The motor is selectively activated by a switch on the lantern housing. When so activated, the focussed beam of light moves back and forth across an enlarged field of vision rapidly enough to fool the eye into seeing substantially continuous illumination.

BRIEF DESCRIPTION OF THE DRAWINGS

FIG. 1 shows a side view, partially in section, of the lantern.

FIG. 2 shows a front view of part of the lantern of FIG. 1.

FIG. 3 is a schematic diagram of the circuitry of the lantern of FIG. 1.

FIG. 4 shows a bottom view, also partially in section, of the front end of the lantern of FIG. 1.

FIG. 5 is an enlarged detail of a portion of FIG. 1.

FIG. 6 is a detail showing the operation of a centering device shown in FIG. 4.

DETAILED DESCRIPTION OF THE INVENTION

Referring to the figures, lantern 1 is comprised of rear housing portion 2 and front housing portion 3. Batteries B are contained in the rear housing portion 2. A recharging system R (FIG. 3) for recharging the batteries B can be also contained in the rear housing 2, or may be externally provided and detachably electrically connected to the batteries as is well known. Front housing portion 3 contains an optical system which includes bulb 4 which is a miniature incandescent lamp of generally known type. Electrical leads 5 electrically connect bulb 4 to batteries B via mechanical switch 6 which selectively activates the bulb 4 and oscillation system as will be explained. A reflector 7 (shown in cross-section) carries holder 15 in a manner to place the bulb 4 at or near the optical focus of the reflector 7. Protective lens 8 of optically clear plastic is arranged in front of housing portion 3 in a conventional manner.

Reflector 7 (FIG. 2) has a shape especially adapted to accomplish the purposes of the instant invention. Specifically, lateral reflective surfaces 7A have a shape of a paraboloid of revolution about a central axis through the bulb 4. This shape is a conventional one for those optical systems intended to form a generally focussed or collimated beam from the point source of light which the miniature bulb 4 closely approximates. However, upper and lower surfaces 7B are generally flat surfaces which truncate the parabolic surface of revolution of which lateral surface 7A is the remainder. The bulb 4 is located in bulb holder 15 which positions the bulb at or near the focal point of at least the parabolic shaped lateral reflective surfaces 7A such that when the switch activates the bulb, the optical system projects a narrow beam of light.

The reflector 7 has mounted to it two metal clips 37 and 39, each with socketed holes which receive opposing pins 11 and 11 which project vertically from the top and bottom inner surface of the front housing portion. The electrical leads are attached to these pins 11 and 11. The clips resiliently engage respective electrical contacts of the bulb 4. Preferably, these pins 11 are mounted along an axis which passes close to or through the center of optical focus of the reflector.

A system for oscillating the optical system includes a motor 9, which is located in front housing portion 3, and is selectively connected to batteries B via a three position switch operated by a conveniently positioned trigger-type switch 6 located approximate handle shaped rear housing portion 2. The switch could also be operated by a thumb operated slide on the top surface of the front housing. FIG. 1 shows the switch 6 in its fully depressed position. The other two positions are shown in phantom which correspond to the positions i and ii also shown in phantom in the wiring diagram of FIG. 3.

Switch 6 carries centering rod 22 which includes forked portion 24 at its forward-most end (see FIGS. 4 and 6). In all but the position corresponding to the fully depressed position of the trigger (as shown in the figures) the forked portion 24 engages and thus positions projection 26 carried on the outer surface of the reflector 7. The operation of this construction will be detailed below.

The motor 9 carries a rotatable disk 32 on its shaft. On the forward face of this disc 32 is a small permanent magnet 34. For smooth operation, the disc also carries a counterbalance weight 36 opposite the shaft.

Two permanent magnets 38, 38 are carried on the outer edges of bulb mount 15 on either side of the the bulb. The poles of these magnets are faced to attract or preferably repel the magnetic forces exerted by the corresponding pole of the motor carried magnet 34.

Upon activation of motor 9, the rotation of the disc 32 brings magnet 34 in close proximity to one and then the other of magnets 38 alternately repelling or attracting one magnet 38 and then the other magnet 38 and thus oscillating the bulb and reflector in a small arc about the pins 11.

In operation, the switch 6 is operated to electrically connect the batteries to the bulb for operation as a conventional flash light to project a narrow beam of light on the scene to be illuminated. In this operation, switch is moved from position i to position ii. The forked portion of the centering rod maintains member 26 in its centered position and the lantern operates essentially as an ordinary flashlight, throwing a collimated beam of light.

Moving the switch 6 to a second position connects the second pole to electrically energize the motor 9 which oscillates the optical system in a plane in the manner set forth above. Moving to this second position also uncouples forked portion 24 from the projection 26 and permits the optical system to respond to the magnetic forces imposed alternately on one and then the other of the magnets 38 as the rotating magnet 34 traverses its circular path. This has the effect of scanning the light beam in a wide swath (relative to the width of the beam), and thus illuminating a generally elongated portion of the scene. It has been found that this oscillation must be accomplished at a rate of at least 10 cycles per second, ideally at 17 cycles per second. At these oscillation frequencies, the illumination of the elongated portion of the scene appears to the operator to be continuous. At substantially slower frequencies, the oscillation of the narrow beam is easily detected and the resulting obviousness of the periodic illumination is apparent. Oscillation frequencies higher than the optimum frequency do not substantially enhance the illumination function, but do tend to increase wear and power usage.

In a working embodiment, a paraboloid of revolution reflector having an overall diameter of about 3⅛" was altered by cutting the top and bottom portions off and replacing the cut sections with substantially flat reflective walls. This alteration had the effect of reducing the area of the exit aperture by about 39% to the beneficial effect of reducing the size and mass of the optical system to be oscillated. Surprisingly, optical tests showed that, despite this radical modification of the optical characteristics of the the reflector, only a slight loss of overall lighting efficiency was detected and the collimated beam was only slightly changed from its previous circular shape.

On energizing the bulb with the correct amount of voltage, the optical system produces a generally circular spot of illumination about 8 feet in diameter at a distance of about 55 feet. While so energized, the motor was powered and the optical system was caused to oscillate at the preferred rate. This oscillation caused what appeared to be a continuous illumination of a swath of light about 47 feet wide and about 8 feet tall. Surprisingly, the intensity of illumination for this entire swath appeared to be undiminished from that provided by the fixed, unoscillated beam.

When a moving object, such as a running person or animal was illuminated by the oscillating beam, stroboscopic nature of the discontinuous illumination became apparent. However, this had the effect of exaggerating the movement so as in a manner to compensate for the lack of continuous illumination.

What has been described then is an electric lantern with a reflector and bulb capable of oscillating to provide an expanded beam of light. Alternative embodiments include pivoting the lamp socket relative to the reflector to cause the beam to be deflected side-to-side. Also contemplated is the use of a reciprocal electrical driver (electromagnetic or piezoelectric) to oscillate the optical system. Alternatively, a simple bell crank linkage between the motor and the optical system would suffice for many applications without departing from the spirit of the invention.

I claim:

1. An electric lantern comprising an optical system for projecting a beam of light, an energy source, a switch operated by the operator of said lantern for selectively connecting said energy source to said optical system, means for oscillating said optical system, and means for selectively activating said oscillating means whereby said means for oscillating, when activated, causes said beam to scan back and forth at oscillation frequencies such that illumination of a relatively wide swath appears to the operator of said electric lantern to be continuous, whereby said beam can be made to illuminate said relatively wide swath.

2. An electric lantern of claim 1 wherein said optical system includes a light bulb.

3. An electric lantern of claim 1 wherein said optical system includes a reflector.

4. An electric lantern of claim 1 wherein said optical system includes a light bulb and reflector.

5. An electric lantern of claim 1 wherein said means for selectively activating said oscillating system includes said switch.

6. An electric lantern of claim 1 wherein said oscillating means includes a motor.

7. An electric lantern comprising an optical system for projecting a beam of light, an energy source, a switch for selectively connecting said energy source to said optical system, means for oscillating said optical system, and means for selectively activating said oscillating means whereby said means for oscillating, when activated, causes said beam to scan back and forth, whereby said beam can be made to illuminate a relatively wide swath wherein said oscillating means includes a first magnet attached to said optical system and means for applying a varying magnetic force to said first magnet whereby said optical system, together with said first magnet, is caused to oscillate in response to said varying magnetic force.

8. An electric lantern of claim 7 wherein said oscillating means includes an electric motor, a rotatable disc mounted on a shaft of said motor, and said means for applying said varying magnetic force comprises a second magnet mounted on said disc a distance from the shaft of said motor, said motor being positioned approximate said optical system so that said second magnet is brought in varying proximity to said first magnet on said optical system.

9. An electric lantern comprising an optical system for projecting a beam of light, an energy source, a switch for selectively connecting said energy source to said optical system, means for oscillating said optical system, and means for selectively activating said oscillating means whereby said means for oscillating, when activated, causes said beam to scan back and forth, whereby said beam can be made to illuminate a relatively wide swath and wherein said means for selectively activating said oscillating system includes said switch, said switch has at least three positions including a first position, a second position wherein said optical system is energized to provide a beam of light, and a third position wherein said optical system is energized to provide a beam of light and said means for oscillating is also energized.

10. An electric lantern of claim 9 further including means for preventing movement of said optical system relative to the rest of said lantern when said means for oscillating is not energized.

11. An electric lantern of claim 10 wherein said means for preventing movement comprises a first portion mounted for movement with said switch, and a mating portion carried by said optical system, said first portion engaging said mating portion when said switch is in said first and said second positions, and said first portion disengaging said mating portion when said switch is in said third position.

12. An electric lantern comprising an optical system for projecting a beam of light, an energy source, a switch for selectively connecting said energy source to said optical system, means for oscillating said optical system, and means for selectively activating said oscillating means whereby said means for oscillating, when activated, causes said beam to scan back and forth, whereby said beam can be made to illuminate a relatively wide swath and wherein said oscillating means oscillates said optical system at a frequency at which the stroboscopic effect caused by said oscillating is minimized.

13. An electric lantern of claim 12 wherein said oscillating means oscillates said optical system at a frequency of at least about 12 cycles per second.

14. An electric lantern of claim 12 wherein said oscillating means oscillates said optical system at a frequency of about 17 cycles per second.

15. An electric lantern comprising an optical system for projecting a beam of light, an energy source, a switch for selectively connecting said energy source to said optical system, means for oscillating said optical system, and means for selectively activating said oscillating means whereby said means for oscillating, when activated, causes said beam to scan back and forth, whereby said beam can be made to illuminate a relatively wide swath and wherein said means for selectively activating said oscillating system includes said switch, including means for preventing movement of said optical system relative to the rest of said lantern when said means for oscillating is not energized comprising a first portion mounted for movement with said switch, and a mating portion carried by said optical system.

16. A hand held lantern comprising a housing having a rear housing portion containing at least one battery, a front housing portion containing an optical system for projecting a narrow beam of light therefrom when electrically energized by said batteries, means for mounting said optical system for pivotal movement relative to said housing, a switch mounted to said housing for operation by a person carrying said lantern, means for oscillating said optical system when energized by said switch whereby said optical system is pivoted back and forth on said means for mounting, means for maintaining said optical system in a centered position relative to said housing when said means for oscillating is not energized by said switch.

17. A hand held lantern as set forth in claim 16 wherein said means for mounting comprises an electrical contact mounted on an upwardly facing surface of said optical system, another electrical contact mounted on a downwardly faeing surface of said optical system, pins mounted to an inside surface of said housing, said pins being electrically connected to said battery and to said switch, said pins being positioned to engage said electrical contact, whereby said optical system pivots about said pins and electrical contact is made to said optical system while oscillating.

18. A hand held lantern as set forth in claim 16 wherein said means for maintaining said optical system in a centered position comprises a first part carried for movement with said switch, and a second part carried by said optical system, said first part engaging said second part when said switch is operated to energize only said optical system, and said first part disengages said second part when said switch is operated to energize said means for oscillating.

19. A hand held lantern as set forth in claim 16 wherein said switch has three operative positions, a first position in which said means for maintaining said optical system centers said optical system and prevents said optical system from pivoting relative to said housing, a second position in which said optical system is energized whereby a narrow beam of light from said optical system is produced in the manner of a conventional flashlight type of hand held lantern, and a third position is which both said optical system and said means for oscillating are energized whereby the beam of light produced by said optical system scans a wide, horizontal area.

20. A hand held lantern as set forth in claim 16 wherein said oscillating means includes a first magnet attached to said optical system and means for applying a varying magnetic force to said first magnet whereby said optical system, together with said first magnet, is caused to oscillate in response to said varying magnetic force.

21. A hand held lantern as set forth in claim 20 wherein said oscillating means includes an electric motor, a rotatable disc mounted on a shaft of said motor, and said means for applying said varying magnetic force comprises a second magnet mounted on said disc a distance from the shaft of said motor, said motor being positioned approximate said optical system so that said second magnet is brought in varying proximity to said first magnet on said optical system.

* * * * *